US010323297B2

(12) United States Patent
Takahashi et al.

(10) Patent No.: US 10,323,297 B2
(45) Date of Patent: *Jun. 18, 2019

(54) METHOD FOR PRODUCING PELLET AND METHOD FOR SMELTING NICKEL OXIDE ORE

(71) Applicant: SUMITOMO METAL MINING CO., LTD., Tokyo (JP)

(72) Inventors: Junichi Takahashi, Tokyo (JP); Taku Inoue, Tokyo (JP); Shuuji Okada, Tokyo (JP)

(73) Assignee: SUMITOMO METAL MINING CO., LTD., Tokyo (JP)

( * ) Notice: Subject to any disclaimer, the term of this patent is extended or adjusted under 35 U.S.C. 154(b) by 106 days.

This patent is subject to a terminal disclaimer.

(21) Appl. No.: 15/325,515

(22) PCT Filed: Jun. 30, 2015

(86) PCT No.: PCT/JP2015/068852

§ 371 (c)(1),
(2) Date: Jan. 11, 2017

(87) PCT Pub. No.: WO2016/009828

PCT Pub. Date: Jan. 21, 2016

(65) Prior Publication Data

US 2017/0152584 A1 Jun. 1, 2017

(30) Foreign Application Priority Data

Jul. 15, 2014 (JP) ..... 2014-144881

(51) Int. Cl.
*C22B 23/02* (2006.01)
*C22B 23/00* (2006.01)
(Continued)

(52) U.S. Cl.
CPC ..... *C22B 23/02* (2013.01); *C22B 1/2406* (2013.01); *C22B 1/2413* (2013.01);
(Continued)

(58) Field of Classification Search
CPC ..... C22B 1/2406; C22B 23/005; C22B 23/02
See application file for complete search history.

(56) References Cited

U.S. PATENT DOCUMENTS 4,195,986 A 4/1980 Schulz et al.
4,659,374 A 4/1987 Alanko et al.
(Continued)

FOREIGN PATENT DOCUMENTS

CA 1332286 C 10/1994
CN 101020958 A 8/2007
(Continued)

OTHER PUBLICATIONS

Youping Zhang, CN 102453824 A, Machine translation of document (Year: 2012).*
(Continued)

*Primary Examiner* — Tima M McGuthry-Banks
(74) *Attorney, Agent, or Firm* — Locke Lord LLP

(57) ABSTRACT

Provided is a method for producing a pellet capable of suppressing heat shock-induced crack occurrence, when nickel oxide ores are made into pellets and placed in a reducing furnace in a smelting process. In the method for producing a pellet from a nickel oxide ore, a nickel oxide ore, a binder and a carbonaceous reducing agent are mixed, the mixture is made into a lump, and then the resulting lump is subjected to a preheat treatment at a temperature of 350° C. to 600° C. In this preheat treatment, the lump more preferably undergoes the preheat treatment at a temperature of 400° C. to 550° C.

4 Claims, 3 Drawing Sheets

(51) Int. Cl.

| | |
|---|---|
| ***C22B 1/24*** | (2006.01) |
| *C22B 5/10* | (2006.01) |
| *C22B 1/245* | (2006.01) |
| *C22C 33/04* | (2006.01) |

(52) U.S. Cl.
CPC ..... *C22B 23/005* (2013.01); *C22B 1/245* (2013.01); *C22B 5/10* (2013.01); *C22C 33/04* (2013.01)

(56) References Cited

U.S. PATENT DOCUMENTS

| | | | | |
|---|---|---|---|---|
| 5,178,666 | A | 1/1993 | Diaz et al. | |
| 2005/0211020 | A1 | 9/2005 | Sugitatsu et al. | |
| 2009/0324440 | A1* | 12/2009 | Marsh | C21B 13/00 420/8 |
| 2011/0308352 | A1 | 12/2011 | Makela et al. | |

FOREIGN PATENT DOCUMENTS

| | | | | |
|---|---|---|---|---|
| CN | 101392329 | A | | 3/2009 |
| CN | 101403043 | A | | 4/2009 |
| CN | 101538645 | A | | 9/2009 |
| CN | 201555450 | U | | 8/2010 |
| CN | 102010986 | A | | 4/2011 |
| CN | 102367512 | A | | 3/2012 |
| CN | 102453824 | A | * | 5/2012 |
| CN | 102758085 | A | | 10/2012 |
| CN | 202912992 | U | | 5/2013 |
| CN | 103233114 | A | | 8/2013 |
| CN | 102758085 | B | | 11/2013 |
| CN | 103436698 | A | | 12/2013 |
| JP | 54153722 | A | * | 12/1979 |
| JP | 02-111840 | A | | 4/1990 |
| JP | 2004-156140 | A | | 6/2004 |
| JP | 2012-517523 | A | | 8/2012 |

OTHER PUBLICATIONS

CN 103233114 A machine translation of the description. (Year: 2013).*
CN 103233114 A written translation of the drawing. (Year: 2013).*
Office Action dated Feb. 16, 2017 issued for corresponding Canadian Patent Application No. 2,954,028.
Extended European Search Report dated Jul. 19, 2017, issued to EP Patent Application No. 15821709.1.
Office Action dated Aug. 4, 2017, issued to CN Patent Application No. 201580034483.X.
International Search Report dated Aug. 11, 2015, issued for PCT/JP2015/068852.
Office Action issued to CA Patent Application No. 2,956,259, dated Mar. 30, 2017.
Office Action issued to U.S. Appl. No. 15/328,634, dated Jul. 19, 2017.
Extended European search report issued to EP Patent Application No. 15828220.2, dated Jul. 24, 2017.
Office Action issued to CN Patent Application No. 201580039569.1, dated Aug. 29, 2017.
Final Office Action issued to U.S. Appl. No. 15/328,634, dated Nov. 13, 2017.

* cited by examiner

METHOD FOR PRODUCING PELLET AND METHOD FOR SMELTING NICKEL OXIDE ORE

TECHNICAL FIELD

The present invention relates to a method for producing pellets, and in more detail, relates to a method for producing pellets upon processing in a step of smelting nickel oxide ore, and a method for smelting nickel oxide ore using this.

BACKGROUND ART

As a method for smelting nickel oxide ore called limonite or saprolite, a method of dry smelting that produces nickel matt using a flash smelting furnace, a method of dry smelting that produces ferronickel using a rotary kiln or moving hearth furnace, a method of wet smelting that produces a mix sulfide using an autoclave, etc. have been known.

Upon loading the nickel oxide ore to the smelting step, pre-processing is performed for pelletizing, making into a slurry, etc. the raw material ore. More specifically, upon pelletizing the nickel oxide ore, i.e. producing pellets, it is common to mix components other than this nickel oxide ore, e.g., binder and reducing agent, then further perform moisture adjustment, etc., followed by loading into agglomerate producing equipment to make a lump on the order of 10 to 30 mm, for example (indicated as pellet, briquette, etc.; hereinafter referred to simply as "pellet").

It is important for this pellet to maintain the shape thereof even if the smelting operations such as loading into a smelting furnace (reducing furnace) and reducing and heating is begun in order to achieve the roles such as preserving breathability and prevention of uneven distribution of raw material components, for example.

For example, Patent Document 1 discloses technology of adjusting excess carbon content of the mixture in a mixing step to make a mixture by mixing raw materials including nickel oxide and iron oxide with carbonaceous reducing agent, as a pre-treatment method upon producing ferronickel using a moving hearth furnace.

However, when pelletizing this mixture in order to load into the reducing furnace, and heating to the reduction temperature, so-called heat-shock may occur whereby the pellets break, and there are problems of inhibiting progression of the smelting reaction, or the product becoming scarcer and recovery becoming difficult. Therefore, commercial operation becomes difficult if not curbing at least the proportion of pellets broken by heat shock to on the order of 10%.

Patent Document 1: Japanese Unexamined Patent Application, Publication No. 2004-156140

DISCLOSURE OF THE INVENTION

Problems to be Solved by the Invention

The present invention has been proposed taking account of such a situation, and has an object of providing a method for producing pellets that can suppress the occurrence of heat shock-induced cracks upon pelletizing nickel oxide ore and loading into a reducing furnace in a smelting process.

Means for Solving the Problems

The present inventors have thoroughly investigated in order to solve the aforementioned problem. As a result thereof, it was found that, upon producing pellets containing nickel oxide ore using a method for smelting nickel oxide ore, it is possible to suppress heat shock-induced cracks when loading into a high-temperature reducing furnace, by conducting preheat treatment at a predetermined temperature after forming into lumps, thereby arriving at completion of the present invention. In other words, the present invention provides the following matters.

A first aspect of the present invention is a method for producing pellets from nickel oxide ore, including preheat treating a lump made by forming the nickel oxide ore into a lump shape at a temperature of 350° C. to 600° C.

In addition, according to a second aspect of the present invention, in the method for producing pellets as described in the first aspect, the lump is preheat treated at a temperature of 400° C. to 550° C.

Furthermore, according to a third aspect of the present invention, in the method for producing pellets as described in the first or second aspect, the lump is preliminarily heated prior to preheat treating the lump.

Moreover, according to a fourth aspect of the present invention, in the method for producing pellets as described in the third aspect, the lump is preliminarily heated by holding at a temperature of 100° C. to 170° C. for at least two hours.

A fifth aspect of the present invention is a method for smelting nickel oxide ore, including: a pellet production step of producing pellets from the nickel oxide ore; and a reduction step of heating the pellets obtained at a predetermined reduction temperature in a reducing furnace, in which a lump made by forming the nickel oxide ore in a lump shape is preheat treated at a temperature of 350° C. to 600° C. in the pellet production step.

In addition, according to a sixth aspect of the present invention, in the method for smelting nickel oxide ore as described in the fifth aspect, after preheat treating the lump to make a pellet in the pellet production step, the pellet is loaded into the reducing furnace in a state retaining the temperature of the preheat treatment.

Effects of the Invention

According to the present invention, it is possible to produce pellets that can maintain the shape thereof by suppressing the occurrence of heat shock-induced cracks, for pellets of nickel oxide ore used in a method for smelting nickel oxide ore.

PREFERRED MODE FOR CARRYING OUT THE INVENTION

Hereinafter, a specific embodiment of the present invention (hereinafter referred to as "present embodiment") will be explained in detail while referencing the drawings. It should be noted that the present invention is not to be limited to the following embodiment, and that various modifications within a scope not departing from the gist of the present invention are possible.

<<1. Method for Smelting Nickel Oxide Ore>>

First, a method for smelting nickel oxide ore, which is raw material ore, will be explained. Hereinafter, it will be explained giving as an example a method of smelting that produces ferronickel by pelletizing nickel oxide ore, which is the raw material ore, then generates metal (ferronickel) and slag by reduction treating these pellets, and then separates this metal and slag.

Figure 1:
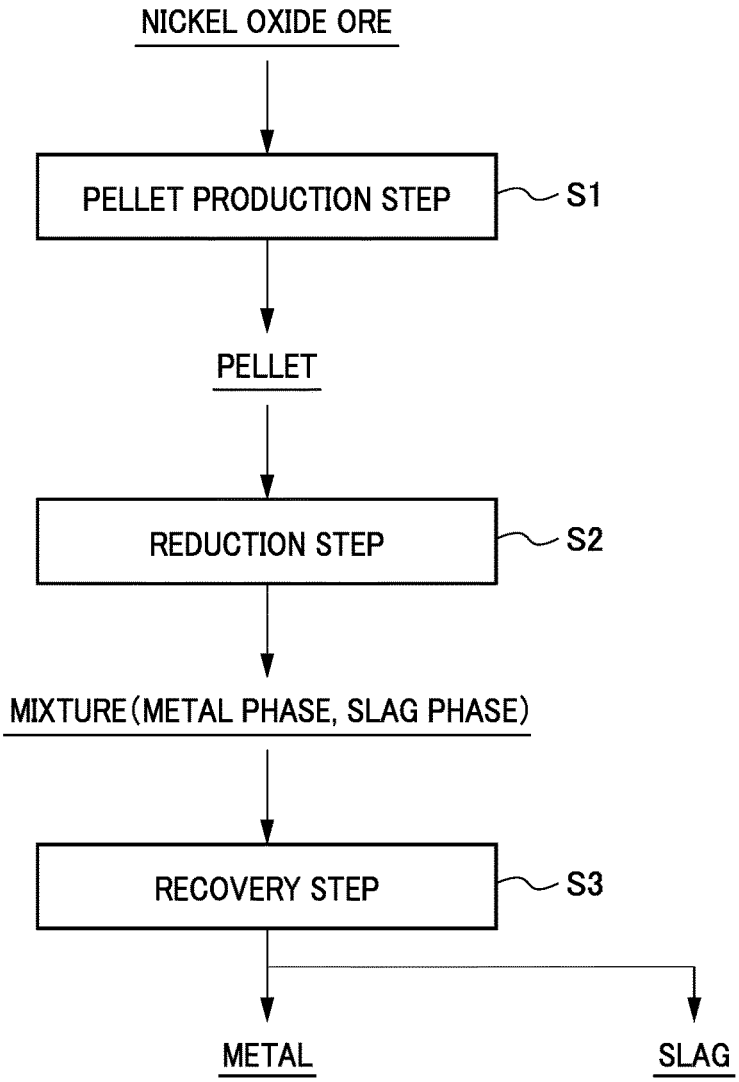
FIG. 1 is a process chart showing the flow of a method for smelting nickel oxide ore.

The method for smelting nickel oxide ore according to the present embodiment is a method of smelting using pellets of nickel oxide ore, by loading these pellets into a smelting furnace (reducing furnace), then reducing and heating. More specifically, as shown in the process chart of FIG. 1, this method for smelting nickel oxide ore includes a pellet production step S1 of producing pellets from nickel oxide ore, a reduction step S2 of heating the obtained pellets in a reducing furnace at a predetermined reduction temperature, and a recovery step S3 of recovering metal by separating the slag and metal generated in the reduction step S2.

<1.1. Pellet Production Step>

Figure 2:
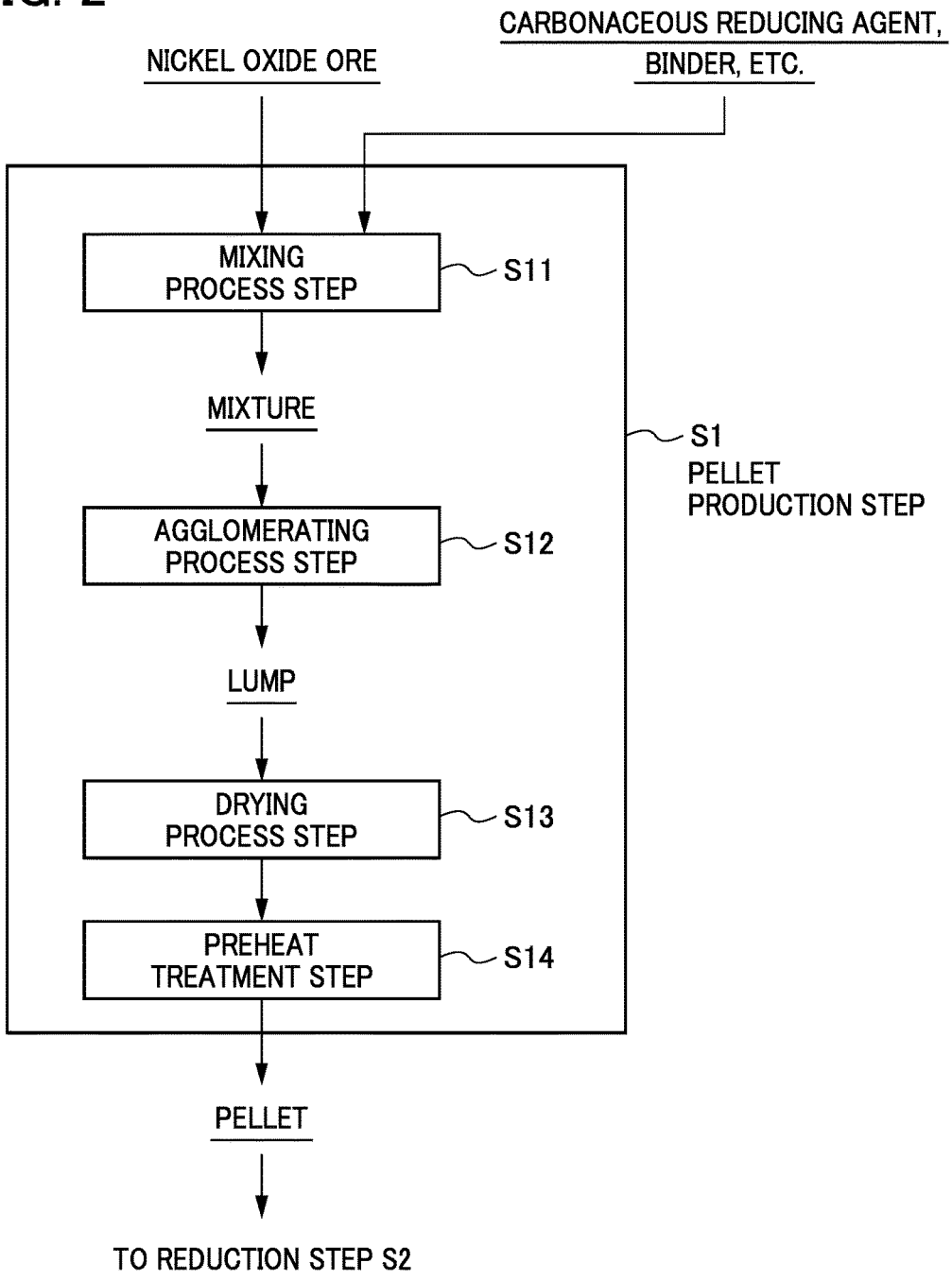
FIG. 2 is a process flow chart showing the flow of processing in the pellet production step of the method for smelting nickel oxide ore.

The pellet production step S1 produces pellets from nickel oxide ore, which is the raw material ore. FIG. 2 is a process flow chart showing the flow of processing in the pellet production step S1. As shown in FIG. 2, the pellet production step S1 includes a mixing process step S11 of mixing the raw materials including the nickel oxide ore, an agglomerating process step S12 of forming (granulating) the obtained mixture into a lump, and a drying process step S13 of drying the obtained lump, and then a pre-heating process step S14 of preheat treating at a predetermined temperature a lump subjected to the drying process.

(1) Mixing Process Step

The mixing process step S11 is a step of obtaining a mixture by mixing the raw material powders including nickel oxide ore. More specifically, this mixing process step S11 obtains a mixture by mixing raw material powders having a particle size on the order of 0.2 mm to 0.8 mm, for example, such as nickel oxide ore that is the raw material ore, iron ore, carbonaceous reducing agent, flux component and binder.

The nickel oxide ore is not particularly limited; however, it is possible to use limonite ore, saprolite ore, etc.

Although the iron ore is not particularly limited, for example, it is possible to use iron ore having iron quality of at least about 50%, hematite obtained from wet smelting of nickel oxide ore, etc.

In addition, powdered coal, pulverized coke, etc. are given as the carbonaceous reducing agent, for example. This carbonaceous reducing agent is preferably equivalent in particle size to the aforementioned nickel oxide ore. In addition, it is possible to give bentonite, polysaccharides, resins, water glass, dewatered cake, etc. as the binder, for example. In addition, it is possible to give calcium hydroxide, calcium carbonate, calcium oxide, silicon dioxide, etc. as the flux component, for example.

An example of the composition of a part of the raw material powder (wt %) is shown in Table 1 noted below. It should be noted that the composition of the raw material powder is not limited thereto.

TABLE 1

| Raw material powder [Wt %] | Ni | $Fe_2O_3$ | C |
|---|---|---|---|
| Nickel oxide ore | 1~2 | 50~60 | — |
| Iron ore | — | 80~95 | — |
| Carbonaceous reducing agent | — | — | ≈85 |

(2) Agglomerating Process Step

The agglomerating process step S12 is a step of forming (granulating) the mixture of raw material powder obtained in the mixing process step S11 into a lump. More specifically, it forms into pellet-shaped masses by adding the moisture required in agglomerating to the mixture obtained in the mixing process step S11, and using a lump production device (such as a rolling granulator, compression molding machine, extrusion machine), etc., or by the hands of a person.

The pellet shape is not particularly limited; however, it can be established as spherical, for example. In addition, although the size of the lump made into pellet shape is not particularly limited, passing through the drying process and preheat treatment described later, for example, it is configured so as to become on the order of 10 mm to 30 mm in size (diameter in case of spherical pellet) of pellet to be loaded into the reducing furnace, etc. in the reduction step.

(3) Drying Process Step

The drying process step S13 is a step of drying the lump obtained in the agglomerating process step S12. The lump made into a pellet-shaped mass by the lumping process becomes a sticky state in which moisture is included in excess at about 50 wt %, for example. In order to facilitate handling of this pellet-shape lump, the drying process step S13 is configured to conduct the drying process so that the solid content of the lump becomes on the order of 70 wt % and the moisture becomes on the order of 30 wt %, for example.

More specifically, the drying processing on the lump in the drying process step S13 is not particularly limited; however, it blows hot air at 300° C. to 400° C. onto the lump to make dry, for example. It should be noted that the temperature of the lump during this drying process is less than 100° C.

An example of the solid content composition (parts by weight) of the pellet-shaped lump after the drying process is shown in Table 2 noted below. It should be noted that the composition of the lump after the drying process is not limited thereto.

TABLE 2

| | Ni | $Fe_2O_3$ | $SiO_2$ | CaO | $Al_2O_3$ | MgO | Binder | Other |
|---|---|---|---|---|---|---|---|---|
| Composition of pellet solid content after drying [Parts by weight] | 0.5~1.5 | 50~60 | 8~15 | 4~8 | 1~6 | 2~7 | 1 measure | remainder |

(4) Preheat Treatment Step

The preheat treatment step S14 is a step of preheat treating the lump having been subjected to the drying process at a predetermined temperature. The method for smelting nickel oxide ore according to the present embodiment is characterized by producing pellets by preheat treating the lump of nickel oxide ore at a predetermined temperature, and loading these pellets into a reducing furnace and reducing and heating.

The preheat treatment on the lump of this preheat process step S14 is described later in detail; however, by producing pellets by preheat treating the lump, it is possible to effectively suppress cracking (breaking, crumbling) of pellets due to heat shock upon the reducing and heating of these pellets at predetermined temperature.

More specifically, by conducting preheat treatment on the lump, it is possible to produce pellets having strength that can maintain shape with a size on the order of 10 mm to 30 mm, e.g., strength for which the proportion of pellets breaking is no more than about 1% even in a case causing to drop from a height of 1 m, for example. The obtained pellets are thereby able to endure shocks such as dropping upon loading into the subsequent process of the reduction step, and can maintain the shape of the pellets, and appropriate gaps are formed between pellets; therefore, the smelting reaction in the smelting step will progress suitably.

<1.2. Reduction Step>

The reduction step S2 reduces and heats the pellets obtained in the pellet production step S1 at a predetermined reduction temperature. By way of the reducing heat treatment of the pellets in this reduction process S2, the smelting reaction progresses whereby metal and slag generate.

More specifically, the reducing heat treatment of the reduction step S2 is performed using a smelting furnace (reducing furnace), and reduces and heats the pellets containing nickel oxide ore by loading into the reducing furnace heated to a temperature on the order of 1400° C., for example. The reducing heat treatment of this reduction step S2, the nickel oxide and iron oxide in the pellets near the surface of the pellet which tends to undergo the reduction reaction first is reduced to make an iron-nickel alloy (hereinafter iron-nickel alloy also referred to as "ferronickel") in a short time of about 1 minute, for example, and forms a husk (shell). On the other hand, the slag component in the pellet gradually melts accompanying the formation of the shell, whereby liquid-phase slag generates in the shell. In one pellet, the ferronickel metal (hereinafter referred to simply as "metal") and the ferronickel slag (hereinafter referred to simply as "slag") thereby generate separately.

Then, by extending the treatment time of the reducing heat treatment of the reduction step S2 up to on the order of 10 minutes further, the carbon component of the surplus carbonaceous reducing agent not contributing to the reduction reaction contained in the pellet is incorporated into the iron-nickel alloy and lowers the melting point. As a result thereof, the iron-nickel alloy melts to become liquid phase.

As mentioned above, although the slag in the pellet melts to become liquid phase, it becomes a mixture coexisting as the separate phases of the metal solid phase and slag solid phase by subsequent cooling, without blending together of the metal and slag that have already generated separately. The volume of this mixture shrinks to a volume on the order of 50% to 60% when comparing with the loaded pellets.

In the case of the aforementioned smelting reaction progressing the most ideally, it will be obtained as one mixture made with the one metal solid phase and one slag solid phase coexisting relative to one loaded pellet, and becomes a solid in a "potbellied" shape. Herein, "potbellied" is a shape in which the metal solid phase and slag solid phase join. In the case of being a mixture having such a "potbellied" shape, since this mixture will be the largest as a particle size, the time and labor in recovery will lessen and it is possible to suppress a decline in metal recovery rate upon recovering from the reducing furnace.

It should be noted that the aforementioned surplus carbonaceous reducing agent is not only mixed into the pellets in the pellet production step S1 and, for example, it may be prepared by blanketing the coke, etc. on the hearth of the reducing furnace used in this reduction step S2.

In the method for smelting nickel oxide ore according to the present invention, as mentioned above, it is configured so as to produce pellets by preheat treating at a predetermined temperature the lumps that have been subjected to the drying process in the pellet production step S1, and these pellets are loaded into a reducing furnace in the reduction step S2 in a state retaining at the preheat treatment temperature thereof, and then reduced and heated. By using the pellets produced by conducting such a preheat treatment, it is possible to decrease the occurrence of heat-shock received upon the reducing and heating, and it is possible to suppress the shape of this pellet from breaking down.

<1.3. Separation Step>

The separation step S3 recovers metal by separating the metal and slag generated in the reduction step S2. More specifically, a metal phase is separated and recovered from a mixture containing the metal phase (metal solid phase) and slag phase (slag solid phase) obtained by the reducing heat treatment on the pellet.

As a method of separating the metal phase and slag phase from the mixture of the metal phase and slag phase obtained as solids, for example, it is possible to use a method of separating according to specific gravity, separating according to magnetism, etc., in addition to a removal method of unwanted substances by sieving. In addition, it is possible to easily separate the obtained metal phase and slag phase due to having poor wettability, and relative to the aforementioned "potbellied" mixture, for example, it is possible to easily separate the metal phase and slag phase from this "potbellied" mixture by imparting shock such as providing a predetermined drop and allowing to fall, or imparting a predetermined vibration upon sieving.

The metal phase is recovered by separating the metal phase and slag phase in this way.

<<2. Preheat Treatment in Pellet Production Step>>

Next, the preheat treatment in the pellet production step will be explained. As mentioned above, the present embodiment is characterized in that, upon producing the pellets from nickel oxide ore, which is the raw material ore, the binder, carbonaceous reducing agent, etc. are mixed with the nickel oxide ore, and after forming this mixture into a lump, this lump is preheat treated at a predetermined temperature.

In the preheat treatment on this lump of nickel oxide ore, the temperature thereof is important, and specifically, the lump is preheat treated to a temperature of 350° C. to 600° C.

By conducting preheat treatment at a temperature of 350° C. to 600° C. on the lump of nickel oxide ore to make pellets, and reducing and heating in the reduction step using this pellet, it is possible to decrease the occurrence of heat-shock received upon the reducing and heating, and it is possible to suppress the shape of the pellet from breaking down in the reduction step. More specifically, even if loading pellets into the reducing furnace heated to a high temperature of about 1400° C., it is possible to make the proportion of pellets breaking among all loaded pellets a slight proportion at less than 10%, and it is possible to maintain the shape in at least 90% of the pellets.

Herein, as a mechanism by which the pellets of nickel oxide ore break down from heat-shock, it is by the temperature of the pellets suddenly rising by loading the pellets into the reducing furnace heated to a high temperature on the order of about 1400° C., and the desorption of crystallization water contained in this nickel oxide ore occurring. In other words, when the temperature of the pellets suddenly rises, the breakage of pellets is considered to occur from the crystallization water vaporizing and expanding to form steam, and passing inside the pellet instantly. It should be noted that crystallization water is not water molecules adhering to particles, but refers to moisture characteristic to nickel oxide ore which is trapped as a crystalline structure.

In this point, by producing the pellets by conducting preheat treatment at a temperature of 350° C. to 600° C. on the lump of nickel oxide ore, it is possible to cause the crystallization water contained in the nickel oxide ore constituting the pellets to decrease. Given this, even in a case of causing the temperature to suddenly rise by loading into a reducing furnace at about 1400° C., it is possible to suppress breakage of pellets from the aforementioned desorption of crystallization water. In addition, by conducting preheat treatment to produce pellets, and subsequently loading these pellets into a reducing furnace to reach the reduction temperature, the thermal expansion of particles such as the nickel oxide ore, carbonaceous reducing agent, binder and flux component constituting the pellets, becomes two stages and will advance slowly, whereby it is possible to suppress the breakage of pellets caused by the expansion difference between particles.

As the preheating temperature for the lump, it is set to the range of 350° C. to 600° C., as mentioned above. By preheat treating the lump made by forming the nickel oxide ore into a mass at a temperature of 350° C. to 600° C., it is possible to configure so as to effectively decrease the crystallization water, and allow thermal expansion to progress slowly, and thus possible to make the frequency of pellet breakage a negligible value less than 10%. If the temperature of the preheat treatment is less than 350° C., the separation of crystallization water contained in the nickel oxide ore will be insufficient, and it will not be possible to effectively suppress breakage of pellets due to the desorption of crystallization water. On the other hand, if the temperature of preheat treatment exceeds 600° C., sudden thermal expansion of particles will be induced by this preheat treatment, and similarly, it will no longer be possible to effectively suppress breakage of pellets.

Furthermore, as the preheat temperature, it is more preferable to set in the range of 400° C. to 550° C. By preheat treating the lump containing nickel oxide ore at 400° C. or higher, the effect of mitigating sudden thermal expansion of particles will further rise, and by setting the preheat treatment temperature to no higher than 550° C., it is possible to avoid heating unnecessary for the separation of crystallization water, and thus possible to efficiency treat. In this way, it is possible to substantially prevent breakage of pellets by preheat treating the lump containing nickel oxide ore at 400° C. to 550° C.

As mentioned above, there are causes of two pathways to pellet breakage by the temperature of pellets suddenly rising from room temperature to the reduction temperature on the order of 1400° C., one being sudden desorption of crystallization water contained in the nickel oxide ore constituting the pellets, and the other one being the sudden thermal expansion of particles constituting the pellets.

In order to suppress the sudden desorption of crystallization water, more specifically, it is important to heat to a temperature of 350° C. to 550° C. It is thereby possible to slowly cause crystallization water to desorb in advance, prior to the pellets rising to the reduction temperature, and thus prevent breakage of pellets caused by sudden desorption of crystallization water.

In addition, in order to suppress the sudden expansion of particles constituting the pellets, more specifically, it is important to preheat to a temperature of 400° C. to 600° C. It is thereby possible to preheat at a temperature from 400° C., which is the minimum temperature tolerable for sudden temperature rise after preheating (rise to reduction temperature) up to 600° C., which is the maximum temperature tolerable for sudden temperature rise as the preheating temperature itself, the expansion of particles can be slowed, and thus it is possible to prevent the breakage of pellets caused by thermal expansion.

Therefore, it is most preferable to preheat treat with the preheat temperature of 400° C. to 550° C., which is the temperature range making it possible to more effectively suppress the breakage of pellets based on the aforementioned causes of two pathways.

As the processing time of the preheat treatment, although it is not particularly limited and may be adjusted as appropriate according to the size of the lump containing nickel oxide ore, it is possible to set to a processing time on the order of 15 minutes to 30 minutes, if a lump of normal size for which the size of the obtained pellet will be on the order of 10 mm to 30 mm.

Now, in the method for smelting nickel oxide ore, it is important to configure so as to load the pellets obtained by performing preheat treatment at the temperature of 350° C. to 600° C. in this way into the reducing furnace heated to the reduction temperature of 1400° C., for example, while in a state retaining at the temperature of this preheat treatment, and then perform the reducing heat treatment.

As mentioned above, as one of the causes of pellet breakage, there is sudden thermal expansion of the particles constituting the pellets, and if allowing the temperature of pellets obtained after the preheat treatment to decline from the preheat treatment temperature, a sudden temperature rise will occur again at the stage of loading this pellet into the reducing furnace, and sudden thermal expansion will occur. Given this, even in a case of producing pellets by performing preheat treatment, the breakage of pellets will occur from this sudden thermal expansion, and there is a possibility of no longer being able to maintain the shape. Therefore, from the viewpoint of the occurrence of such thermal expansion, it is preferable to load the pellets obtained after the preheat treatment into the reducing furnace for the subsequent process of the reduction step, without allowing to decline from this preheat treatment temperature.

Figure 3:
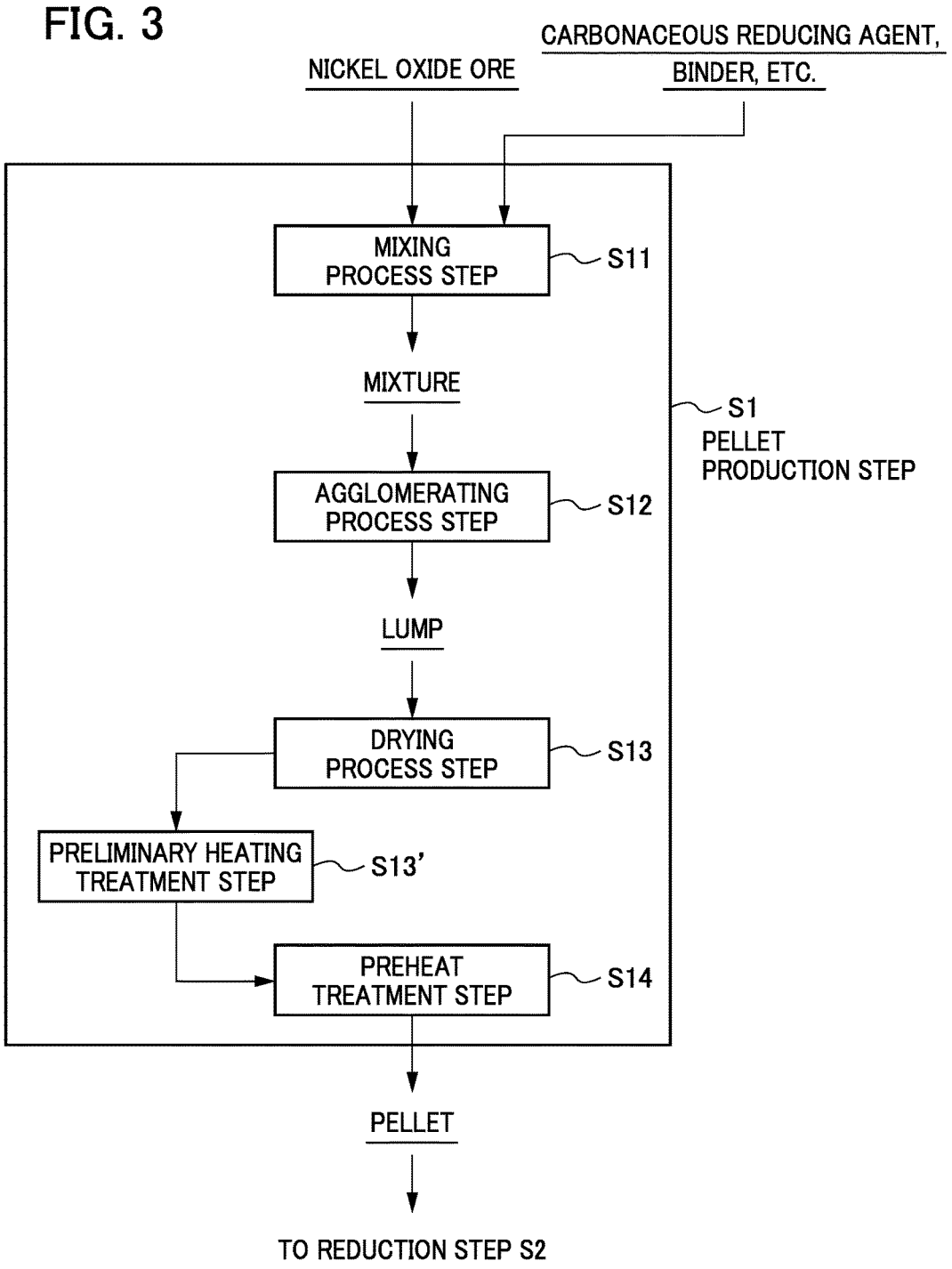
FIG. 3 is a process flow chart showing the flow of processing in a pellet production step of a method for smelting nickel oxide ore.

In addition, as shown in the flowchart of FIG. 3, it is preferable to preliminarily heat the lump made by forming the nickel oxide ore into a mass prior to the aforementioned preheat treatment (preliminary heat treatment step S13').

Adhesive water contained in the nickel oxide ore constituting the lump, i.e. lump after the drying process, for example, contains solid content on the order of 70 wt % and moisture on the order of 30 wt %, and the sum total of the moisture added in order for efficient granulation and the adhesive water that had been contained in the original raw material powders can be sufficiently evaporatively removed by performing preheat treatment of the aforementioned lump. Incidentally, by removing moisture such as this adhesive water in advance preceding this preheat treatment, for example, it is possible to suppress a decline in the effect of preheat treatment accompanying the removal of adhesive water like the preheat treatment itself becoming insufficient by the heating being insufficient. In other words, by performing preliminary heating on the formed lump preceding the preheat treatment, it becomes possible to more effectively conduct preheat treatment subsequently, and it is possible to suppress breakage of pellets by effectively decreasing the crystallization water.

The temperature of preliminary heating in the preliminary heat treatment step S13' is not particularly limited, and it is possible to adjust as appropriate according to the size of the lump, so long as being able to evaporatively remove the entire amount of adhesive water in the formed lump. Thereamong, for example, if being a lump of normal size for which the size of the obtained pellet will be on the order of 10 mm to 30 mm, it is preferable to preliminarily heat this lump at a temperature of 100° C. to 170° C., and hold for over 2 hours or more.

If the preliminary heating temperature is less than 100° C., the hold time of preliminary heating will become long due to the evaporation rate of adhesive water being slow. On the other hand, if the preliminary heating temperature exceeds 170° C., an improvement in the effect of adhesive water removal will decrease. In addition, if the hold time of preliminary heating is less than 2 hours, there is a possibility of not being able to evaporate almost the entire amount of adhesive water. Therefore, by preliminarily heating the lump containing nickel oxide ore over 2 hours or more at a temperature of 100° C. to 170° C., it is possible to more effectively remove almost the entire amount of adhesive water contained.

It should be noted that, regarding preliminary heating, since the removal of adhesive water contained in the nickel oxide ore is the object as mentioned above, there is no necessity for loading to a following step successively while retaining the temperature thereof after preheat treatment, and the temperature may decline so long as being conditions for which the moisture does not increase after preliminary heating.

EXAMPLES

Hereinafter, the present invention will be explained more specifically by showing Examples and Comparative Examples; however, the present invention is not to be limited to the following Examples.

Example 1

Nickel oxide ore serving as raw material ore, iron ore, coal, which is a carbonaceous reducing agent, silica sand and limestone which are flux components, and binder were mixed to obtain a mixture. Next, a lump was formed by adding the appropriate moisture to the mixture of raw material powders obtained, and kneading by hand. Then, a drying process was conducted by blowing hot air at 300° C. to 400° C. onto the lump so that the solid content of the obtained lump become about 70 wt %, and the moisture about 30 wt %. The solid content composition of the lump after the drying process is shown in Table 3 noted below.

TABLE 3

| | Ni | $Fe_2O_3$ | $SiO_2$ | CaO | $Al_2O_3$ | MgO | Binder | Other |
|---|---|---|---|---|---|---|---|---|
| Composition of pellet solid content after drying [Parts by weight] | 0.7 | 52.5 | 14.8 | 5.5 | 3.3 | 6.0 | 1 | remainder |

Next, preheat treatment was performed on the lump after the drying process to produce a pellet. More specifically, the preheat treatment holding the lump at 350° C. for 30 minutes was performed to obtain a pellet. Subsequently, the obtained pellet was loaded, while holding at a temperature of 350° C., into a smelting furnace (reducing furnace) with a reduction temperature set at 1400° C., and reducing and heating were performed.

One-hundred pellets were loaded into the reducing furnace, the state after 3 minutes (time of a range for which melting of shell does not progress, and form of pellets is maintained) was observed, the number of broken pellets was counted, and the percentage was calculated as the proportion of pellets that broke (number broken/number loaded).

As a result thereof, the proportion of broken pellets was slight at 8% in Example 1.

Example 2

Except for producing pellets by performing preheat treatment that held the lump at 600° C. for 30 minutes, pellets obtained similarly to Example 1 were reduced and heated.

As a result thereof, the proportion of broken pellets was slight at 9% in Example 2.

Example 3

Except for producing pellets by performing preheat treatment that held the lump at 400° C. for 30 minutes, pellets obtained similarly to Example 1 were reduced and heated.

As a result thereof, the proportion of broken pellets in Example 3 was 0%, and thus entirely unbroken.

Example 4

Except for producing pellets by performing preheat treatment that held the lump at 450° C. for 30 minutes, pellets obtained similarly to Example 1 were reduced and heated.

As a result thereof, the proportion of broken pellets in Example 4 was 0%, and thus entirely unbroken.

Example 5

Except for producing pellets by performing preheat treatment that held the lump at 550° C. for 30 minutes, pellets obtained similarly to Example 1 were reduced and heated.

As a result thereof, the proportion of broken pellets in Example 5 was 0%, and thus entirely unbroken.

Comparative Example 2

Except for producing pellets by performing preheat treatment that held the lump at 300° C. for 30 minutes, pellets obtained similarly to Example 1 were reduced and heated.

As a result thereof, the proportion of broken pellets in Comparative Example 1 became 50%, and thus the commercial smelting operation of nickel oxide ore was difficult.

Comparative Example 2

Except for producing pellets by performing preheat treatment that held the lump at 650° C. for 30 minutes, pellets obtained similarly to Example 1 were reduced and heated.

As a result thereof, the proportion of broken pellets in Comparative Example 2 became 55%, and thus the commercial smelting operation of nickel oxide ore was difficult.

The invention claimed is:

1. A method for producing pellets on the order of 10 to 30 mm in size from nickel oxide ore, comprising:

conducting a preliminarily heat treatment to heat a lump made by forming the nickel oxide ore into a lump shape at a temperature of 100° C. to 170° C., and then conducting heat treatment to heat the lump after conducting the preliminary heat treatment at a temperature of 450° C. to 600° C.

2. The method for producing pellets according to claim 1, wherein the lump is preliminarily heated by holding for at least two hours in the preliminary heat treatment.

3. A method for smelting nickel oxide ore, comprising:

a pellet production step of producing pellets on the order of 10 to 30 mm in size from the nickel oxide ore; and a reduction step of heating the pellets produced at a predetermined reduction temperature in a reducing furnace, wherein a pellet is produced in the pellet production step by conducting a preliminary heat treatment that heats a lump made by forming the nickel oxide ore into a lump shape at a temperature of 100° C. to 170° C., and then conducting heat treatment that heats the lump after conducting the preliminary heat treatment at a temperature of 450° C. to 600° C.

4. The method for smelting nickel oxide ore according to claim 3, wherein, after conducting heat treatment on the lump to make a pellet in the pellet production step, the pellet is loaded into the reducing furnace in a state retaining the temperature of the heat treatment.

* * * * *